US011236980B2

(12) United States Patent
Thuman et al.

(10) Patent No.: US 11,236,980 B2
(45) Date of Patent: Feb. 1, 2022

(54) DEVICE AND METHOD FOR COUNTERACTING CONTACT-IMPACT EVENTS OF ELONGATED SUB-PROJECTILES

(71) Applicant: BAE SYSTEMS BOFORS AB, Karlskoga (SE)

(72) Inventors: Christer Thuman, Karlskoga (SE); Ulf Heiche, Karlskoga (SE); Reijo Vesa, Gyttorp (SE)

(73) Assignee: BAE SYSTEMS BOFORS AB, Karlskoga (SE)

( * ) Notice: Subject to any disclaimer, the term of this patent is extended or adjusted under 35 U.S.C. 154(b) by 0 days.

(21) Appl. No.: 16/764,450

(22) PCT Filed: Sep. 26, 2018

(86) PCT No.: PCT/SE2018/050973
§ 371 (c)(1),
(2) Date: May 15, 2020

(87) PCT Pub. No.: WO2019/108104
PCT Pub. Date: Jun. 6, 2019

(65) Prior Publication Data

US 2020/0355479 A1 Nov. 12, 2020

(30) Foreign Application Priority Data

Nov. 28, 2017 (SE) ..... 1700293-2

(51) Int. Cl.
*F42B 12/62* (2006.01)

(52) U.S. Cl.
CPC ..... *F42B 12/62* (2013.01)

(58) Field of Classification Search
CPC ..... F42B 12/60; F42B 12/62; F42B 14/06; F42B 14/065; F42B 14/068
USPC ..... 102/389, 438, 457, 489, 492, 494, 495, 102/506, 520
See application file for complete search history.

(56) References Cited

U.S. PATENT DOCUMENTS 3,656,433 A 4/1972 Thrailkill et al.
4,212,244 A * 7/1980 Flatau ..... F42B 5/03 102/438
4,262,597 A * 4/1981 Olson ..... F42B 12/50 102/502
4,264,045 A 4/1981 Campbell
(Continued)

OTHER PUBLICATIONS

International Search Report (dated Dec. 13, 2018) for corresponding international App. PCT/SE2018/050973.

*Primary Examiner* — Bret Hayes
(74) *Attorney, Agent, or Firm* — WRB-IP LLP

(57) ABSTRACT

A holding device and method for decreasing the contact-impact event on sub-projectiles when fired from a barrel, cylinder, carrier shell or the like includes a core and at least two legs that at least partially enclose at least one sub-projectile each. When a projectile is fired from a barrel or the like the sub-projectiles load the legs of the device which are deformed and open up and release the sub-projectiles in a controlled manner without tumbling which leads them to hit and penetrate their target with the short-side. A holding device including sub-projectiles and a projectile including the holding device are also provided.

8 Claims, 3 Drawing Sheets

(56) References Cited

U.S. PATENT DOCUMENTS

| | | | | | |
|---|---|---|---|---|---|
| 4,479,438 | A * | 10/1984 | Bilsbury | F42B 7/08 | 102/452 |
| 4,656,947 | A * | 4/1987 | Gordon | F42B 12/745 | 102/438 |
| 4,676,167 | A * | 6/1987 | Huber, Jr | F41B 3/04 | 102/393 |
| 4,770,101 | A | 9/1988 | Robertson et al. | | |
| 5,817,969 | A | 10/1998 | Ellmueller | | |
| 6,073,560 | A * | 6/2000 | Stone | F42B 14/064 | 102/522 |
| 6,668,814 | B1 * | 12/2003 | Borrell | F41B 3/04 | 124/6 |
| 6,957,609 | B2 * | 10/2005 | Ronn | F42B 12/60 | 102/489 |
| 8,047,136 | B2 * | 11/2011 | MacDougall | F42B 12/02 | 102/502 |
| 8,069,791 | B1 * | 12/2011 | Kunstmann | F42B 14/064 | 102/520 |
| 8,931,416 | B2 * | 1/2015 | Schneider | F42B 12/60 | 102/489 |
| 2007/0144397 | A1 * | 6/2007 | Hall | F41C 9/08 | 102/522 |

* cited by examiner

DEVICE AND METHOD FOR COUNTERACTING CONTACT-IMPACT EVENTS OF ELONGATED SUB-PROJECTILES

BACKGROUND AND SUMMARY

The present invention relates to the field of spin stabilized projectiles containing a releasable payload. More particularly the invention relates to a device for counteracting contact-impact events upon firing of a projectile leading to improved effect/penetration of the sub-projectiles to the target.

When elongated sub-projectiles (rods, flechettes, submunitions etc.) are fired out of a barrel, separated from a carrier shell or cylinder, the sub-projectiles rotate either relative to a stationary barrel, or the barrel, carrier shell or cylinder rotates together with the sub-projectiles. The sub-projectiles are affected by the centrifugal forces which give rise to a tumbling motion when the centre of gravity of the projectiles/sub-projectiles pass the muzzle of the barrel/cylinder, or are released from a carrier shell, (see FIG. 1). The tumbling motion means that the projectiles/sub-projectiles tumbles uncontrollably and many meet their target wide-sided, which results in poorer impact and penetration.

U.S. Pat. No. 3,656,433 provides a method for reducing shot dispersion by using a viscoelastic matrix utilized to hold flechettes or other types of small missiles or shots in a unitary projectile form until the unit are released from the gun barrel and until it has substantially passed through the blast region area.

U.S. Pat. No. 5,817,969 discloses a method to avoid contact-impact event of the payload, i.e., sub-projectiles, when the payload is released from a carrier shell, i.e., the payload chamber opens essentially along a casing line from the bottom to the top (cap) and the sub-projectiles are released from the carrier shell when the shell opens up, thereby avoiding contact-impact events. The construction is complex and heavy; the aim is also to fill the casing with maximum number of sub-projectiles for improved hit rate, i.e., quantity.

In view of the background there is a need of developing a device that allows the sub-projectiles to leave the barrel, carrier shell or the like with decreased interference of the centrifugal forces leading to decreased tumbling of the sub-projectiles thereby obtaining increased effect/penetration.

It is desirable to provide a device that decreases and/or counter-acts the tumbling effect of projectiles/sub-projectiles fired from a barrel, cylinder, carrier shell or the like.

According to an aspect of the present invention, a holding device counteracts the contact-impact event on sub-projectiles when they are fired from a barrel, cylinder, carrier shell or the like. The holding device comprises a core having at least two legs. The legs enclose at least partially at least one sub-projectile each.

In one embodiment the number of legs is in the range of two to twelve. In yet another embodiment the number of legs is in the range of two to six. The number and design of the legs varies and depends on the type of projectile to be used. The number and the design of the legs depend on the type of sub-projectiles to be enclosed.

Generally, the holding device comprises a core from where at least two legs are protruding. The legs are protruding from the core in a circular symmetric manner and evenly distributed around the core. If two legs are utilized they are separated by 180 degrees, three legs 120 degrees, four legs 90 degree, etc.

The holding device may for example be made of plastics. In another embodiment it may be made of aluminium. In yet another embodiment the holding device may be made of magnesium. A holding device made of steel, preferably soft steel, is also provided.

The holding device may in another embodiment be made of a combination of material.

The holding device of the present invention may be manufactured by molding, but other processes known by the art is also possible.

In one embodiment of the holding device each leg can enclose up to S sub-projectiles.

The holding device may in one embodiment be enclosed by a cover. A cover may surround the holding device, e.g., surrounding the outside on the legs. In another embodiment a cover can be used for preventing the sub-projectiles from falling out from the holding device, e.g., as top or bottom cover. The holder may also be used in combination with a payload container.

It is also desirable to provide the holding device, as described above, comprising sub-projectiles. The sub-projectiles may be of any suitable kind.

A payload container comprising a holding device of the present invention and sub-projectiles can be arranged in a projectile, preferably in the payload chamber of a carrier shell.

It is also desirable to provide a projectile comprising said holding device comprising sub-projectiles as described above. In one example the projectile is a dividable projectile, comprising a payload chamber, a time fuze and a separation charge arranged behind the payload chamber for separating the payload chamber from the projectile in the forward direction of the projectile.

It is also desirable to provide a process for decreasing the tumbling effect when firing projectiles/sub-projectiles from a barrel, cylinder, carrier shell or the like. The tumbling effect of a sub-projectile is counteracted or decreased when the holding device described above is used. A leg of the holding device encloses at least partly a sub-projectile. The rotation implies that the sub-projectile loads the leg which is deformed and opens up, which results in that the sub-projectile is released outside the muzzle or opening without tumbling, i.e., in a controlled manner.

The present invention also provides a process for adapting a commercial projectile for firing sub-projectiles without or decreased contact-impact events when passing a barrel/cylinder, carrier shell or the like. The process comprises the steps of

- arranging sub-projectiles in a holding device as defined above,
- firing the projectile, and
- releasing the sub-projectiles from the barrel/cylinder, carrier shell or the like thereby loading the legs of the device which are deformed and opens up and releasing the sub-projectiles in a controlled manner without tumbling which leads them to hit and penetrate their target with the short-side.

The loading of the sub-projectiles is due to the centrifugal forces and the rotation that implies that the sub-projectiles load the legs.

The holding device is preferably arranged in a payload chamber of a projectile.

In general, the holding device of the present invention can be arranged in any suitable commercial projectile, thereby providing a projectile that does not suffer from contact-impact events upon firing the projectile from a barrel or the like.

BRIEF DESCRIPTION OF DRAWINGS

The invention is now described, by way of example, with reference to the accompanying drawings, in which.

DETAILED DESCRIPTION

Before the invention is disclosed and described in detail, it is to be understood that this invention is not limited to particular materials or configurations disclosed herein as such configurations and materials may vary. It is also to be understood that the terminology employed herein is used for the purpose of describing particular embodiments only and is not intended to be limiting since the scope of the present invention is limited only by the appended claims.

The present invention will now be described in more detail with reference to the accompanying figures, in which different embodiments of the invention are shown. This invention may, however, be embodied in many different forms and should not be construed as limited to the embodiments set forth herein.

In context of the present invention the term sub-projectile means a small weapon or device that is part of a larger warhead and separates from it prior to impact, e.g., rods, flechettes, or arrow-like darts, i.e., not only munitions of various kinds, but all kinds of payloads, from which a specific continued flight on a determined flight path is expected after its release.

In context of the present invention the term contact-impact events means the event when the projectile/sub-projectile is fired/released from a barrel, carrier shell, cylinder or the like and pass the muzzle-edge resulting in disturbances and tumbling of the sub-projectile.

In context of the present invention the term holding device defines devices that at least partly enclose and arrange sub-projectiles.

Figure 1:
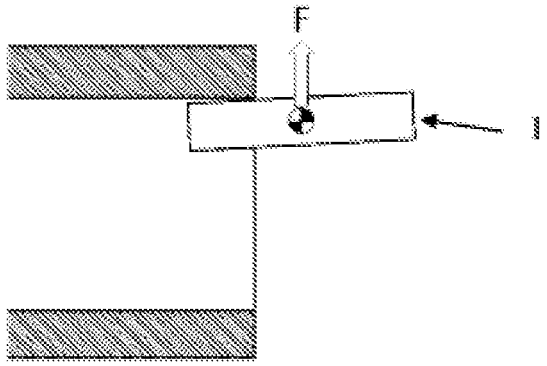
FIG. 1: Shows a schematic side-view demonstrating the contact-impact event at a muzzle of fired sub-projectiles causing the tumbling effect.

When a sub-projectile is emerging from a muzzle or opening of a barrel or being separated forward from a carrier shell or a cylinder, the sub-projectiles will rotate either in relation to a stationary barrel, or the barrel or carrier shell rotates together with the sub projectiles. Due to the rotation, the sub-projectiles are influenced by the centrifugal force (F, FIG. 1) which gives rise to a tumbling motion when the centre of gravity of the sub-projectile is outside the muzzle or opening of the barrel/cylinder/carrier shell. The uncontrolled tumbling of the sub-projectiles results in that they hit their target with the broad-side (i.e., contact-impact event) which leads to less effect/penetration.

An ideal solution would be that the sub-projectiles are released from the barrel/cylinder, or carrier shell without tumbling.

Figure 2A:
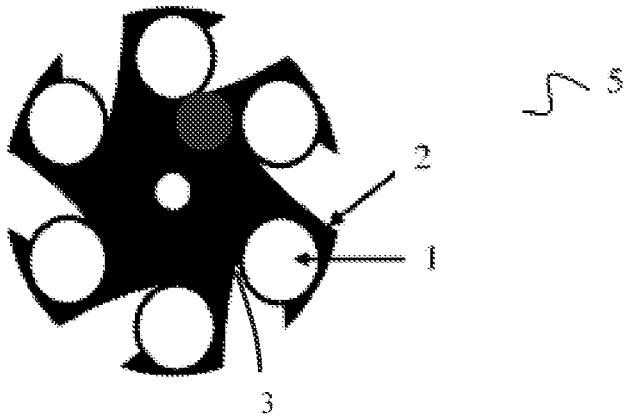
FIG. 2*a-c*: Shows a cross-section of a holding device and the arrangement of sub-projectiles (a), the release of the sub-projectiles in a controlled manner (b), and how the sub-projectiles are leaving the holding device (c).

FIG. 2*a* shows an example of a holding device 5 with the purpose to overcome the problems caused by the centrifugal forces described above.

The holding device 5 comprises a core 3 with protruding legs 2 arranged to it. The core 3 and legs 2 can be manufactured in one piece, or the legs 2 may be arranged to the core 3 in a separate step.

In some embodiments the centre of the core 3 it is a bore for arrangement of a continuous detonator wire, for example a shock tube or an electric wire.

The legs 2 are in this embodiment six, but in other embodiments the number may vary between 2-50 depending on the type of carrier shell, holder or purpose. Usually, the number of legs is in the range of 2-50, or 2-25, 2-12 2-6, 2-4 or only 2.

The legs 2 are in this embodiment at least partially enclosing the sub-projectiles 1, and in this example there is one sub-projectile 1 enclosed per leg 2.

Figure 2B:
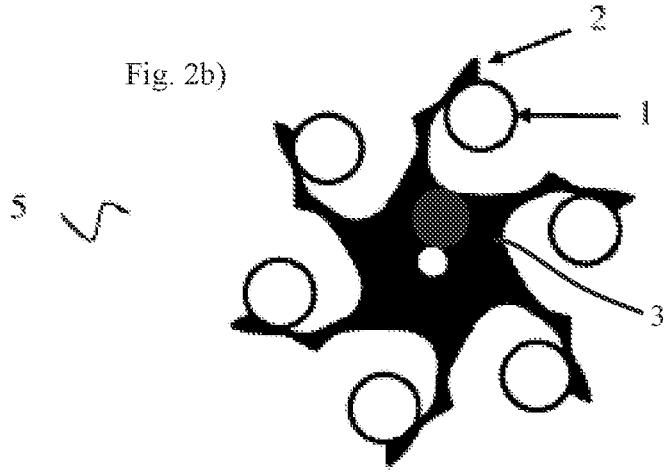
Figure 2C:
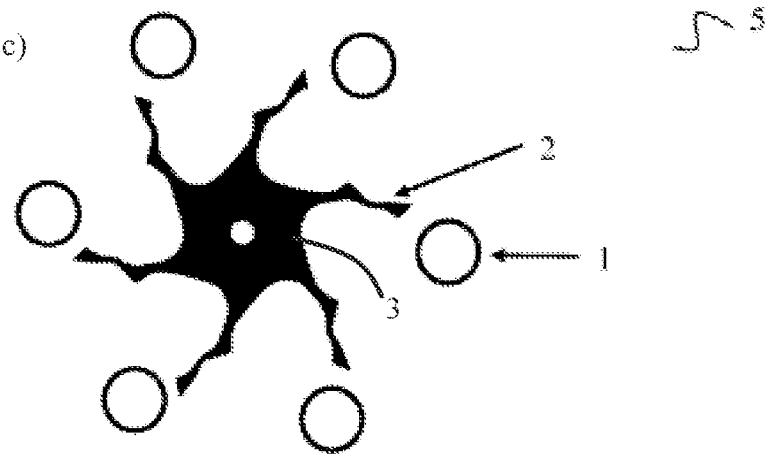

When sub-projectiles 1 are released from a barrel/cylinder, carrier shell or the like, the device is deformed due to the centrifugal forces and the rotation implies that the sub-projectiles 1 load the legs 2 which are deformed and opens up (FIG. 2*b*). The sub-projectiles 1 are then released in a controlled manner (FIG. 2*c*) and will not tumble which leads them to hit and penetrate their target with the short-side, as desired.

The holding device 5 may for example be made of plastics, aluminium, magnesium, or steel, or a combination of said materials. The core 3 and the legs 2 can be made of different materials. The holding device (5) may be manufactured by molding.

Figure 3A:
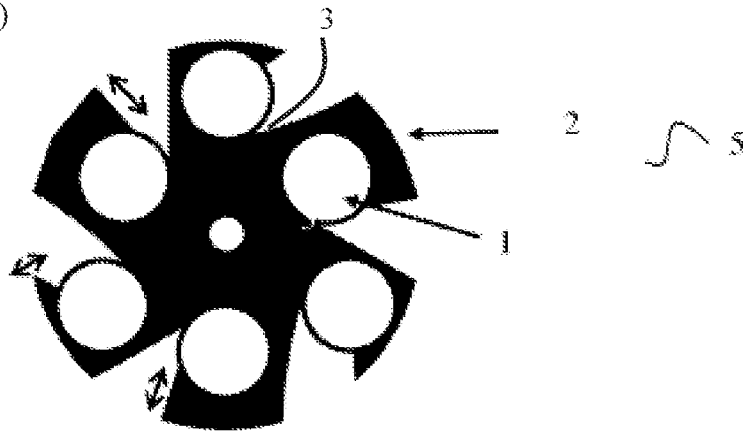
FIGS. 3*a-c* Show cross-sections of different embodiments of the holding device, wherein the sub-projectiles are at different distance from the centre of the device (a), several layers of sub-projectiles are partially enclosed by legs (b), and a plurality of sub-projectiles at least partly surrounded by a common supporting leg (c).
Figure 3B:
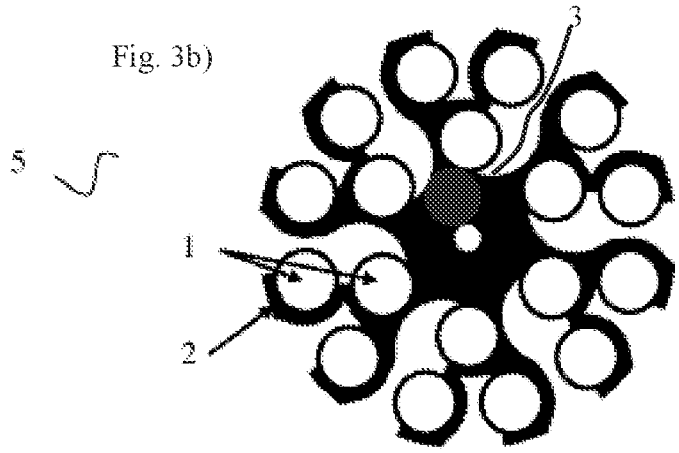
Figure 3C:
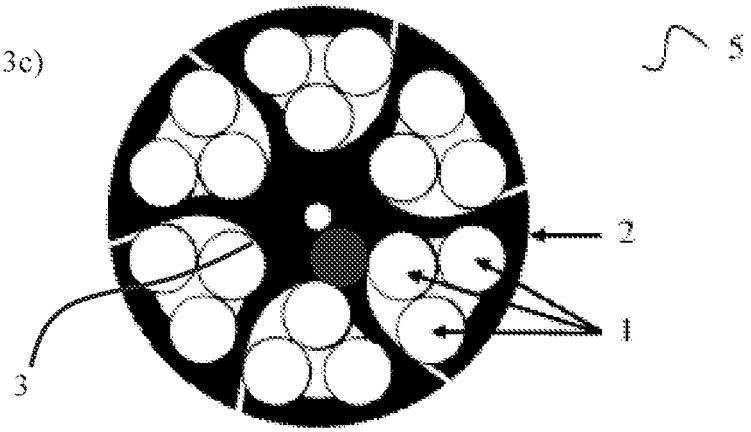

FIGS. 3*a-c* show different examples of embodiments of a holding device 5 and its arrangement of legs 2 and sub-projectiles 1.

In the embodiment of FIG. 3*a* the distance of the sub-projectiles 1 to the centre of the core 3 is varied.

The embodiment shown in FIG. 3*b* has several layers of sub-projectiles 1 enclosed by a leg 2 which is divided into two legs 2 or more.

The embodiment in FIG. 3*c* shows an example of a more closed design. The holding device 5 comprises different compartments separated by the legs 2, and each compartment comprises a plurality of sub-projectiles 1. Three sub-projectiles 1 are in this example enclosed by one leg 2.

The number of legs 2 and/or sub-projectiles 1 is scalable and is not intended to be limiting.

In the embodiments shown here the legs 2 enclose the sub-projectiles 1 from the left, but other embodiments are also possible.

Generally, the holding device 5 comprises a core 3 from where at least two legs 2 are protruding. The legs 2 are protruding from the core in a circular symmetric manner and evenly distributed around the core. If two legs 2 are utilized they are separated by 180 degrees, three legs 120 degrees, four legs 90 degree, etc.

Figure 4A:
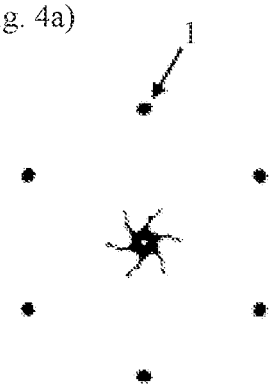
FIGS. 4*a-b* Illustrates the dispersion pattern of the sub-projectiles obtained when using the holding device of the present invention (a) compared to prior art (b).
Figure 4B:
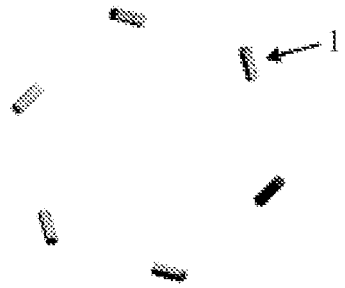
Fig. 4b) PRIOR ART

FIG. 4 illustrates the effect of using the present invention, i.e., the holding device 5, when pluralities of sub-projectiles are fired from a barrel/cylinder, a carrier shell or the like. In FIG. 4*a* the sub-projectiles are released from the holding device 5 and hit the target with the short-side (arrow). In FIG. 4*b* are the sub-projectiles released without using the holding device 5 of the present invention, and it is clearly shown that the sub-projectiles tumble and hit the target with the broad-side (arrow) which is less penetrating and effective.

Clockwise as shown in FIG. 2*a* provides best result.

Figure 5:
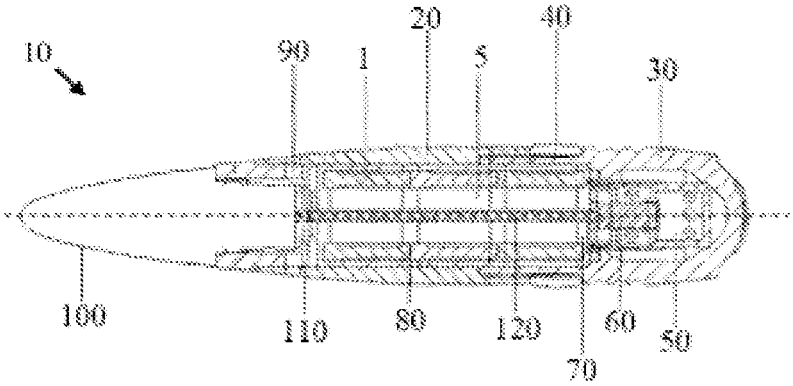
FIG. 5 Shows a schematic side-view of a projectile comprising a plurality of holding devices of the present invention.

FIG. 5 shows a cross-view of an example of a projectile 10 suitable for comprising the holding device 5 of the present invention. The projectile 10 comprises a front projectile body 20 and a rear projectile body 30, and a belt 40. The front 20 and the rear projectile body 30 are joined by means of for example a threaded connection, shrink connection and/or press-fit connection. The rear projectile body 30 comprises a separation charge 50 and a pyrotechnic primer device 60 for initiating the separation charge 50. The primer device 60 is arranged in front of the separation charge 50 behind a drive plate 70 adjacent to the rear end of a payload chamber 80 and the front projectile body 20. The separation charge 50 may consist of or comprise a propellant charge of conventional type, for example a propellant charge comprising a smokeless nitrocellulose propellant, or in an alternative embodiment a composite propellant.

The payload chamber 80 arranged in the front projectile body 20 comprises at least one holding device 5 comprising sub-projectiles 1. A time fuze comprising an activation unit for activating the primer device 60 is arranged in the nose part 100 of the front projectile body 20, in front of the payload chamber 80. The nose part 100 is fitted to the front projectile body 20 by a second drive plate 110 and by for example shear pins 90, which are designed to rupture under the effect of the pressure on the separation of the payload chamber 80 from the projectile 10. In an alternative embodiment a continuous detonator wire 120, for example a shock tube, is arranged between the pyrotechnic primer device 60 and the front part 20 for separating the nose part (fuze) 100 from the projectile 10.

The holding device 5 of the present invention is intended to be used in commercially available projectiles. The holding device 5 is manufactured separately, and suitable sub-projectiles 1 are inserted into the holding device. At least one holding device 5 comprising sub-projectiles is thereafter arranged in a suitable projectile/carrier.

Sub-projectiles suitable for the holding device of the present invention are for example small calibre e.g. 12 gauge shotgun: rods, flechettes, medium calibre e.g. 40 mm, 57 mm: rods, flechettes, armor-piercing wolfram carbide projectiles and large calibre e.g. 120 mm, 155 mm sub-munitions, flechettes, rods.

In summary, the invention provides a holding device 5 for decreasing or eliminating contact-impact events that occur when sub-projectiles are released from a barrel, cylinder or a carrier shell. Advantages of the present invention are among other things: reduced or eliminated tumbling leading to improved penetration into and effect on the target; the size of the fins and the stabilization distance can be reduced of aerodynamic stabilized sub-projectiles; the sub-projectiles are fixed in a carrier shell when it is fired and before separation.

The invention claimed is:

1. A holding device for counteracting a contact-impact event on elongated sub-projectiles when fired from a spin stabilized carrier shell, wherein the holding device comprises a core comprising at least two legs at least partially enclosing at least one sub-projectile each, wherein the holding device is deformed due to centrifugal forces influencing the sub-projectiles caused by rotation of the sub-projectiles such that the sub-projectiles are released in a controlled manner upon being fired from the carrier shell, wherein the core is wider in cross-section when viewed in a direction of a longitudinal axis of the holding device than any of the at least two legs, and wherein the holding device is molded, and the legs of the holding device are deformable relative to the core.

2. The holding device according to claim 1, wherein the at least two legs include up to twelve legs.

3. The holding device according to claim 1, wherein the holding device is made of plastics, aluminium, magnesium, or steel.

4. The holding device according to claim 1, wherein the legs can enclose up to five sub-projectiles each.

5. The holding device according to claim 1, comprising sub-projectiles.

6. A projectile comprising a holding device according to claim 1.

7. A process for adapting a projectile for firing sub-projectiles without or decreased contact-impact events when fired from a barrel/cylinder, or carrier shell, by arranging the holding device comprising elongated sub-projectiles in a projectile according to claim 6.

8. A process for counteracting the contact impact event of a sub-projectile fired from a spin stabilized carrier shell, wherein said process comprises the following steps:

arranging sub-projectiles in a holding device comprising a core comprising at least two leas at least partially enclosing at least one sub-projectile each, wherein the holding device is adapted to be deformed due to centrifugal forces influencing the sub-projectiles caused by rotation of the sub-projectiles such that the sub-projectiles are released in a controlled manner upon being fired from the carrier shell, wherein the core is wider in cross-section when viewed in a direction of a longitudinal axis of the holding device than any of the at least two legs, and wherein the holding device is molded, and the legs of the holding device are deformable relative to the core.

firing the sub-projectile from the carrier shell, and releasing the sub-projectiles from the holding device so that the legs of the holding device deform relative to the core and open up due to the centrifugal forces caused by rotation wherein the sub-projectiles are released in a controlled manner upon being fired from the carrier shell.

* * * * *